US005413087A

United States Patent [19]

Jean

[11] Patent Number: 5,413,087

[45] Date of Patent: May 9, 1995

[54] CONVERTIBLE PORTABLE COOKER

[75] Inventor: Kuan-May Jean, Taoyuan, Taiwan, Prov. of China

[73] Assignee: Khan's Enterprise Co., Ltd., Taoyuan, Taiwan, Prov. of China

[21] Appl. No.: 177,107

[22] Filed: Jan. 3, 1994

[51] Int. Cl.[6] ..... F24C 3/00

[52] U.S. Cl. ..... 126/41 R; 126/38; 126/50

[58] Field of Search ..... 126/25 R, 9 R, 9 B, 126/25 A, 41 R, 50, 15 R, 39 D, 41 D

[56] References Cited

U.S. PATENT DOCUMENTS

| | | | |
|---|---|---|---|
| 1,012,054 | 12/1911 | Berry . | |
| 1,038,849 | 9/1912 | Carter . | |
| 1,085,671 | 2/1914 | Day . | |
| 3,593,647 | 7/1971 | Copeland, Jr. | 99/259 |
| 3,696,803 | 10/1972 | Holloway, Jr. | 126/276 |
| 3,785,361 | 1/1974 | Mejyr et al. | 126/41 |
| 3,802,413 | 4/1974 | Pepin | 126/25 |
| 3,870,031 | 3/1975 | Kruper | 126/39 |
| 4,062,341 | 12/1977 | Panzarella | 126/41 |
| 4,334,462 | 6/1982 | Hefling | 99/385 |
| 4,446,846 | 5/1984 | Hahn | 126/25 |
| 4,553,524 | 11/1985 | Wheat | 126/41 R |
| 4,603,684 | 8/1986 | Kazuo et al. | 126/299 |
| 4,677,964 | 7/1987 | Lohmeyer et al. | 126/41 |
| 4,681,083 | 7/1987 | Shu | 126/41 R |
| 4,773,319 | 9/1988 | Holland | 99/446 |
| 4,877,015 | 10/1989 | Yamada | 126/299 |
| 4,909,235 | 3/1990 | Boetcker | 126/9 |
| 4,922,887 | 5/1990 | Foxford | 126/41 |
| 4,944,284 | 7/1990 | O'Quin | 126/41 |
| 5,065,735 | 11/1991 | Bourgeois et al. | 126/50 |

OTHER PUBLICATIONS

"Replacement Parts" (2 pp.) Magma Products, Inc. Publication date unknown.

*Primary Examiner*—James C. Yeung

*Attorney, Agent, or Firm*—Christensen, O'Connor, Johnson & Kindness

[57] ABSTRACT

A gas burner is mounted in the base of a surrounding bowl, with an encircling open wire stand for a cooking utensil. A utensil supported on the stand is heated directly by the burner. Optionally, the utensil can be removed and a metal plate supported on the stand, with a top grill rack fitted in the upper portion of the bowl. In that case, heat from the burner is distributed by the metal plate substantially uniformly to the top grill rack for grilling food. Consequently, the composite cooker is quickly and easily convertible for use as a stove to heat a cooking utensil or as a barbecue for grilling.

13 Claims, 4 Drawing Sheets

CONVERTIBLE PORTABLE COOKER

FIELD OF THE INVENTION

The present invention relates to a cooking device having a stand for supporting a cooking utensil above a gas burner, such device being convertible for use as a barbecue grill.

BACKGROUND OF THE INVENTION

Copeland, Jr., U.S. Pat. No. 3,593,647, issued Jul. 20, 1971, discloses a cooking device having a gas burner supported in a tubular container. A removable cooking grate has a peripheral rim for resting on an in-turned bead of the container, above the burner, for supporting a pot. Alternatively, a conical plate can be mounted above the burner for radiating heat more uniformly to a top grill rack. Consequently, the cooking device can be used either as a stove whereby a cooking utensil supported on the grate is heated directly by the burner or, with the conical plate inserted, as a barbecue for grilling food supported on the top rack.

Pepin U.S. Pat. No. 3,802,413, issued Apr. 9, 1974, discloses a camp stove having a burner in a bottom drawer. With the drawer closed, the burner can be used to light charcoal for barbecuing, or the drawer can be opened to expose the burner for heating a cooking utensil.

Panzarella U.S. Pat. No. 4,062,341, issued Dec. 13, 1977, discloses a portable cooking device having an internal burner and a top rim designed for supporting a wok. Alternatively, a grill rack can be supported on the top of the device for supporting other types of cooking utensils.

Hahn U.S. Pat. No. 4,446,846, issued May 8, 1984, discloses a gas cooking device having side-by-side "fire grate modules" such that one module can be inserted for barbecuing while the other side is used for heating a pot or a pan.

Kazuo et al. U.S. Pat. No. 4,603,684, issued Aug. 5, 1986, discloses a gas cooking device having an annular "holder" above a burner. Different utensil supports or grates can be mounted in the holder for different cooking operations.

Yamada U.S. Pat. No. 4, 877,015, issued Oct. 31, 1989, discloses a cooking device similar to the Kazuo et al. device in that different types of supports (i.e., a grill rack or a pot stand) can be mounted above a burner.

Boetcker U.S. Pat. No. 4,909,235, issued Mar. 20, 1990, discloses another cooking device having an annular support for different types of cooking utensils and a removable top grill rack.

O'Quin U.S. Pat. No. 4,944,284, issued Jul. 31, 1990, discloses yet another cooking device having an internal support for a pot or pan (see FIGS. 4 and 5) and a removable upper rack for grilling.

The devices of the patents discussed above are representative of prior efforts to provide a portable cooker usable for different cooking operations, but there still exists a need for a sturdy, compact cooker which is easy to use and is effective for heating standard cooking utensils and also for barbecuing or grilling.

SUMMARY OF THE INVENTION

The present invention provides a portable cooker that supplies uniform heat distribution to an upper rack for grilling and barbecuing, but which is quickly and easily convertible for use as a stove to heat a cooking utensil. In the preferred embodiment, a gas burner is mounted by a threaded nipple in the base of a surrounding bowl. Tightening the burner on the nipple also secures both an open wire stand above the base of the bowl and an adjustable valve plate below the base of the bowl. The bowl and valve plate have vent apertures, the open area of the apertures being adjustable by swinging the valve plate.

For use as a stove, a cooking utensil is placed on the open wire stand. Preferably, the top of the stand is angled upward and outward from a location above the burner so that the utensil is substantially self-centering over the burner. The open wire design assures that heat is conducted directly to the cooking utensil for fast and efficient heating.

For use as a barbecue, a thick metal plate is placed on the open wire stand. Such plate has an annular outer portion angled identically to the top of the support with scattered through apertures for some direct dry heat convection through the plate. The central portion of the metal plate is dished and unapertured, immediately above the burner. Above the metal plate, the bowl of the cooking device has a peripheral ledge for supporting a grill rack spaced above the plate.

The top of the bowl can be closed by a lid for roasting.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figure 1:
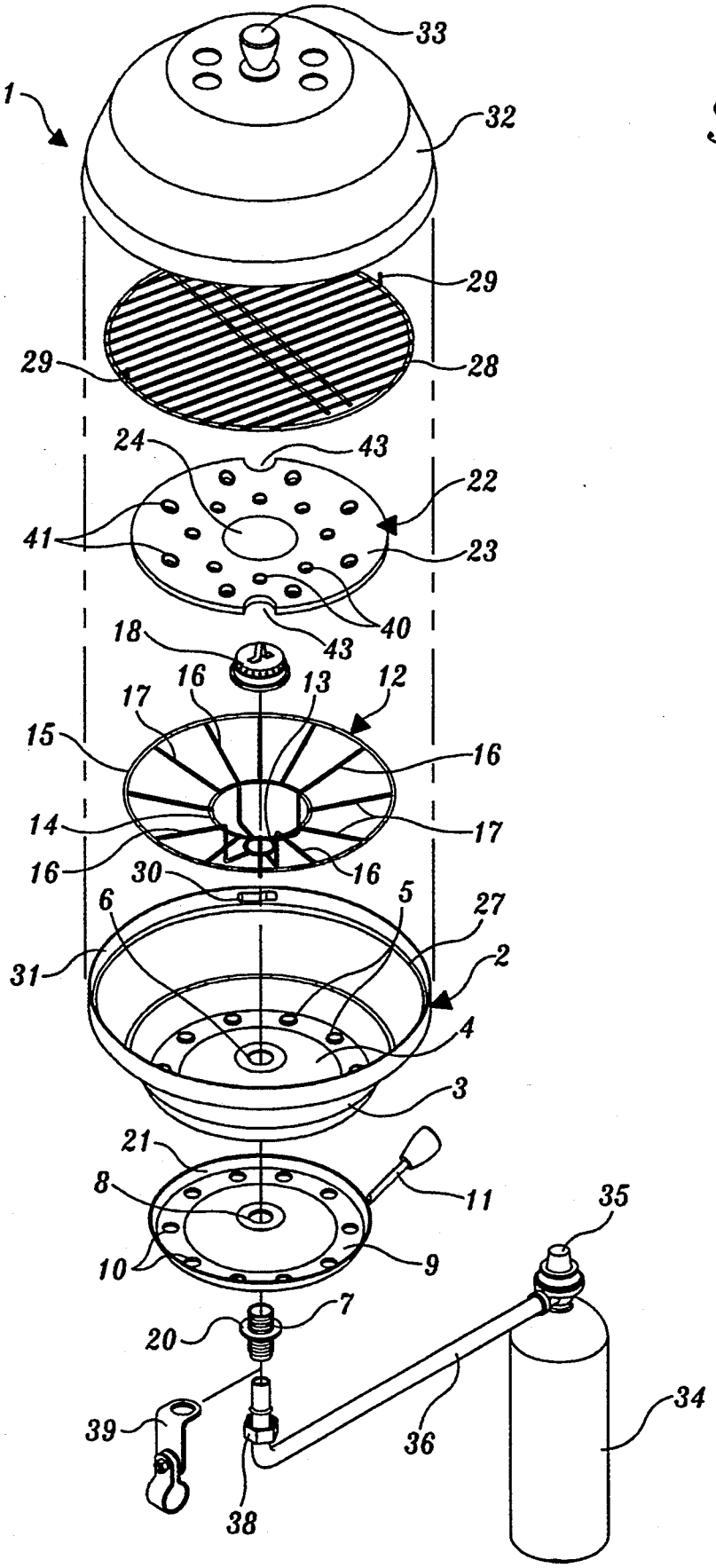
FIG. 1 is a top perspective of a convertible portable cooker in accordance with the present invention, with parts shown in exploded relationship.
Figure 2:
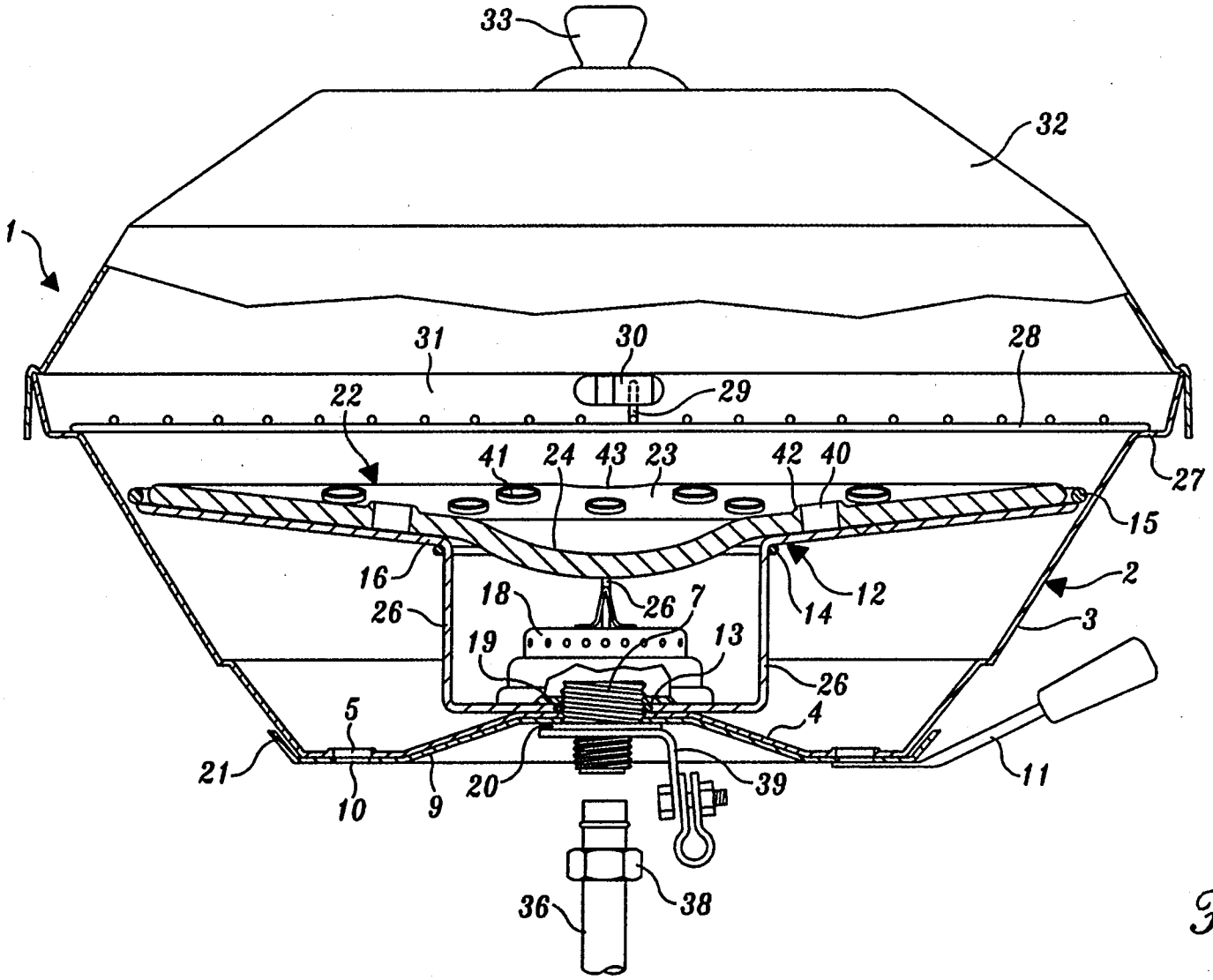
FIG. 2 is a side elevation of the cooker of FIG. 1 with most parts assembled and with parts broken away.

With reference to FIG. 1 and FIG. 2, the convertible portable cooker 1 in accordance with the present invention has an open topped body or bowl 2 formed of metal sheet material such as stainless steel. The bowl is generally conical, including a peripheral wall 3 flared outward and upward and a generally horizontal base 4. The base has a ring of outer vent apertures 5 and a central aperture 6. The central aperture is sized to receive an externally threaded nipple 7 which projects through a corresponding aperture 8 of a bottom valve plate 9.

Valve plate 9 has a ring of vent apertures 10 in alignment with the base apertures 5. A handle 11 projecting from the valve plate 9 can be used to rotate the valve plate relative to the bowl so as to adjust the effective open area of the vent apertures 5 and 10. For example, in a first position of the valve plate, the apertures 10 are fully registered with apertures 5 for maximum venting. From such position, rotation of the valve plate by use of the handle 11 moves apertures 10 progressively out of registration with apertures 5 to lessen the open vent area.

An open wire stand 12 is mounted inside the cooker bowl 2. Such stand has three progressively larger horizontal circular rings 13, 14 and 15, respectively, joined by four rods 16. The bottom ring 13 is of a diameter only slightly greater than the diameter of the bowl aperture 6 and the upper end portion of the threaded nipple 7. The inner and bottom ends of rods 16 are butt welded to ring 13 and, initially, extend horizontally and radially outward to perpendicular bends. From such bends the rods 16 extend vertically upward to the middle ring 14. Rods 16 can be welded to ring 14 and, from there, extend upward and outward at a small acute angle to horizontal to the top and outermost ring 15. The upper and outer ends of rods 16 are welded to the underside of ring 15. Additional straight rods 17 are connected between rings 14 and 15 by welding. Rods 17 and the straight upper portions of rods 16 define a frustoconical supporting area for a cooking utensil such as a pot, pan, kettle, steamer, griddle, and so on.

A conventional gas burner 18 has a base plate 19 screwed onto the upward projecting nipple 7 above the bottom ring 13 of the stand 12. As best seen in FIG. 2, the burner fits closely within the cylindrical area defined by the lower portions of the bent rods 16. Tightening of the burner on the upper portion of the nipple secures the stand 12 in position, centered in the bowl 2. In addition, a central flange 20 of the nipple engages against the underside of the valve plate 9 to secure it against the base of the bowl. Preferably, the valve plate has an angled outer rim 21 that fits close alongside the bottom portion of the bowl wall 3 to prevent air from leaking between the valve plate and the base of the bowl.

A removable heat-radiating metal plate 22 is contoured to rest securely on the open wire stand 12. Such plate includes an outer annular portion 23 angled upward and outward at a small acute angle, preferably about 6°, corresponding to the angle of the support rods 16 and also the intermediate rods 17 shown in FIG. 1. Plate 22 also includes a dished central portion 24 forming a top concave depression in the center of the plate. The dished central portion 24 is spaced above the top of the burner 18 which is shorter than the vertical stretches 26 of the support rods 16. Also, the outer diameter of the plate 22 is slightly less than the diameter of the outer ring 15 of the stand 12. The combined result is that the plate is self-centering on the stand with the dished portion located inside and below the middle ring 14.

The cooker bowl wall 3 is formed with a narrow ledge 27 at a height above the top of the metal plate 22. Ledge 27 supports the periphery of a circular lattice grill rack 28. Rack 28 can have one or more vertical fingers 29 for fitting under spring clips 30 along the top vertical lip 31 of the bowl wall to secure the grill rack in position. The top of the bowl can be closed by a dome lid 32 having a top knob 33.

With reference to FIG. 1, gas from a conventional bottle 34 is supplied to the burner 18 through a conventional valve 35, conduit 36 and the threaded nipple 7. A nut 38 can secure a conventional mounting bracket 39 on the nipple in addition to coupling conduit 36 to the nipple. Bracket 39 can be of conventional configuration, the bracket shown being representative of those which are used for mounting the cooker on the rail of a boat.

Figure 3:
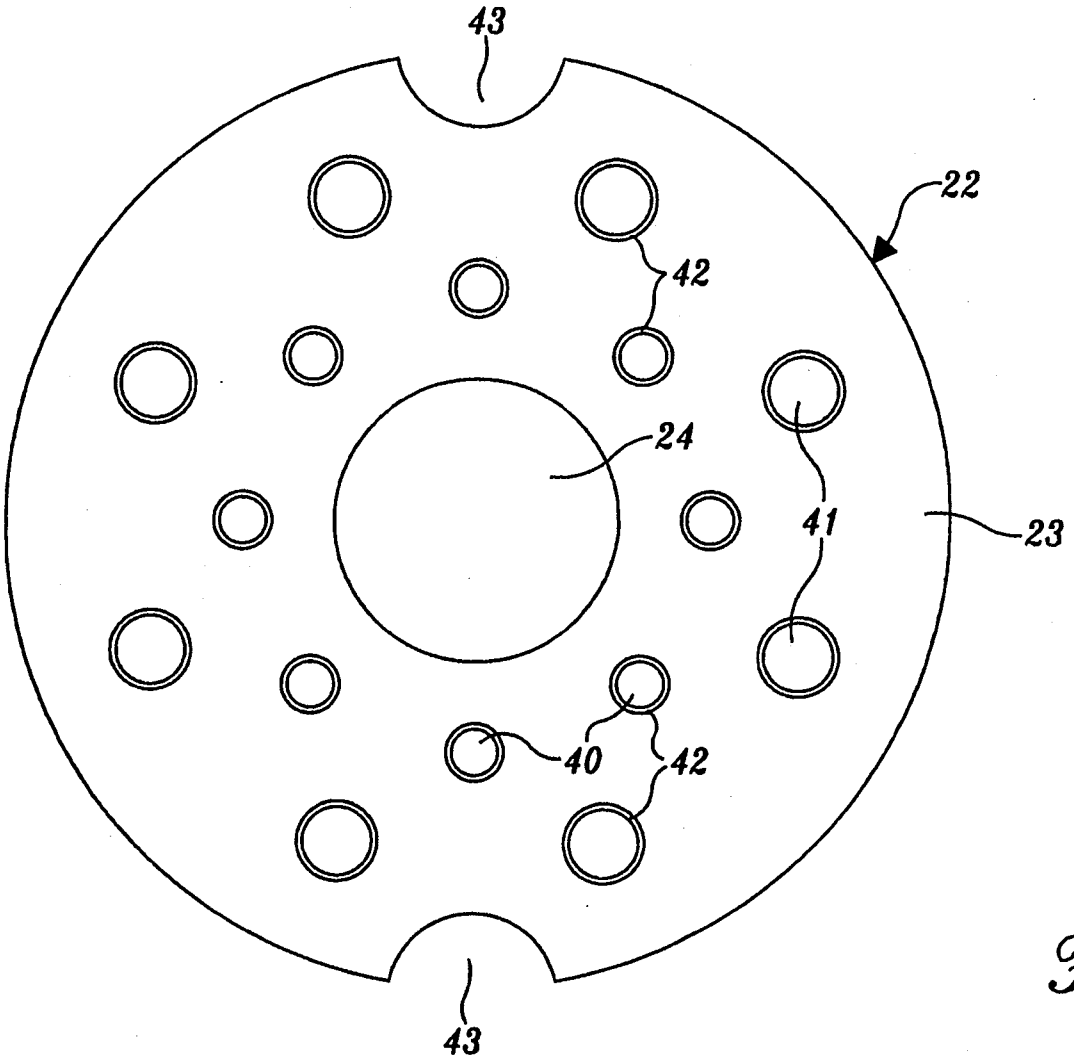
FIG. 3 is a top plan of a component of the cooker of FIG. 1, namely, the heat-radiating plate.

To use the cooker as a barbecue, the burner is lit to heat the plate 22 which rests on the open wire stand 12. The vast majority of the underside of the plate is directly exposed to heat from the burner so that the plate will heat quickly. In addition, the outer portion 23 of the plate has through apertures 40 and 41 for conveying hot air upward toward the grill rack 28. Preferably, such apertures are sized to achieve fairly uniform heating of food placed on the grill rack. In the illustrated embodiment, as best seen in FIG. 3, the outer portion 23 of the plate has an inner ring of small apertures 40 and an outer ting of larger apertures 41. The apertures are sized and located for essentially uniform airflow to the grill rack. In addition to grilling by heat of air passing through the apertures, the plate itself radiates heat to the rack. Oil from the heated food will drip down onto the plate 22 and be burned for a charbroiled flavor. The apertures 40 and 41 have raised margins or rims 42 to deter oil from passing downward through the apertures into the bottom of the cooker bowl 2.

Figure 4:
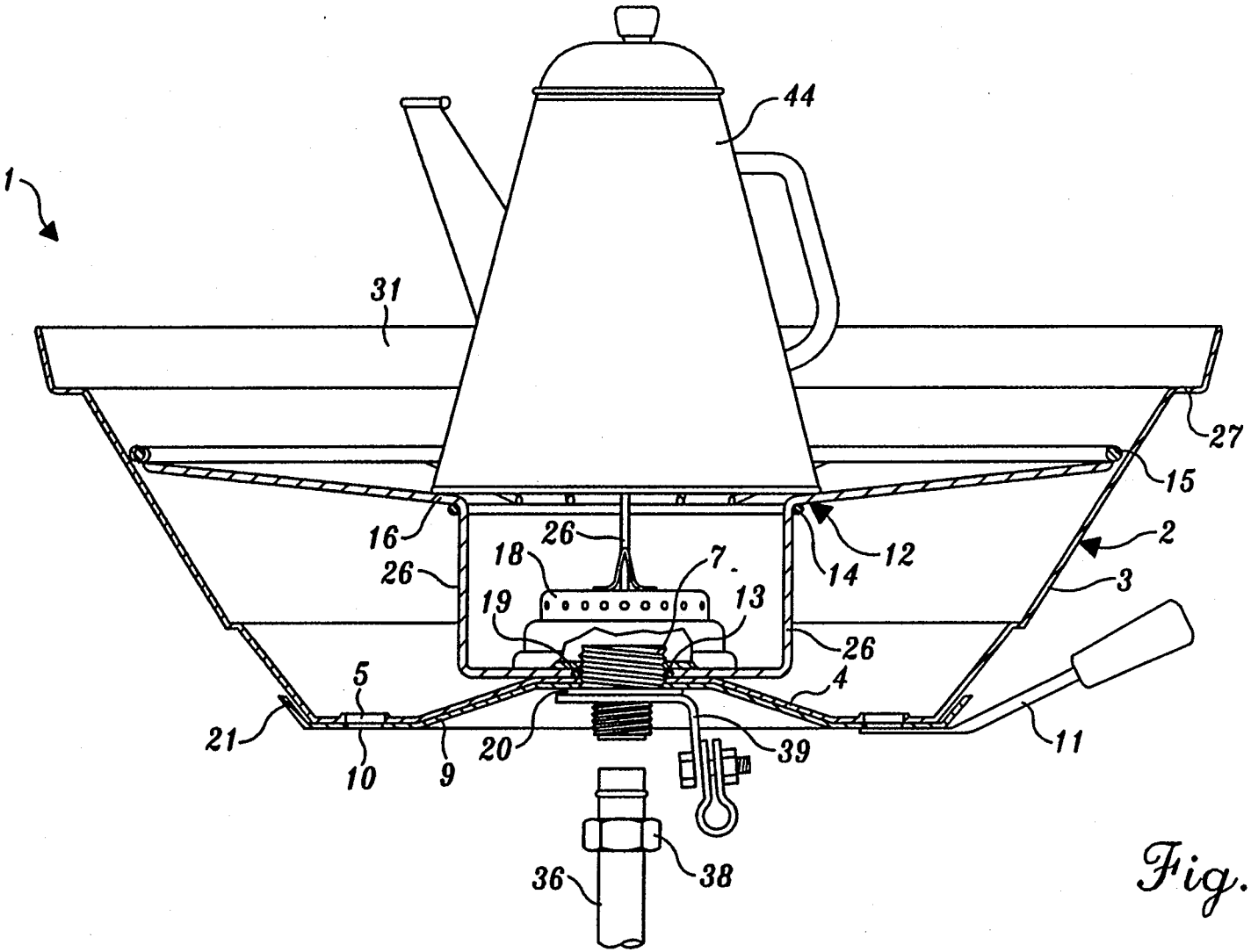
FIG. 4 is a side elevation corresponding to FIG. 2 but with parts removed to illustrate use of the cooker as a stove.

In addition to functioning as an efficient barbecue, the cooker in accordance with the present invention can be quickly convened to use as a stove for heating a conventional cooking utensil. In that case, the top grill rack 28 is removed by rotating it to free the fingers 29 from the spring clips 30 and lifting it out of the bowl 2. Next, the heat-radiating plate 22 is removed, such as by use of diametrically opposed finger notches 43. With the plate removed, the open wire stand 12 is exposed and the desired cooking utensil or vessel can be supported on the stand. For example, FIG. 4 illustrates a coffeepot 44 having its base resting on the inner portion of the angled top of the stand. Again, the open wire construction of the stand assures quick, direct heating of the cooking utensil.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A cooker convertible between operation as a barbecue for grilling food and a stove for heating a cooking utensil, said cooker comprising a bowl having a substantially closed base and an open top, a burner mounted on said base, an open wire stand mounted on said base and extending upward therefrom to a location above said burner for supporting the cooking utensil thereon during use of the cooker as a stove, a grill rack removably mounted in the upper portion of said bowl, above said stand, for supporting food thereon during operation of the cooker as a barbecue, and a metal plate supportable directly on said stand, above said burner but below said grill rack, for distributing heat from said burner to said grill rack during use of the cooker as a barbecue, said stand having a base portion fitted between said burner and said bowl base for mounting said stand to said bowl base.

2. The cooker defined in claim 1, in which the bowl includes a peripheral wall, the stand having an outer periphery spaced inward from said peripheral wall.

3. The cooker defined in claim 1, in which the stand has an upper portion defining a generally frustoconical supporting area for the cooking utensil.

4. The cooker defined in claim 3, in which the upper portion of the stand is angled upward and outward at a small acute angle.

5. The cooker defined in claim 4, in which the metal plate has an outer annular portion angled upward and outward at a small acute angle approximately equal to the small acute angle of inclination of the upper portion of the stand, such that the metal plate fits on the stand substantially coincidentally with the frustoconical supporting area.

6. The cooker defined in claim 5, in which the stand has a central open portion registered vertically with the burner, the metal plate having a central depression for fitting in said open portion for centering of the metal plate on the stand.

7. The cooker defined in claim 1, in which the metal plate has through apertures located for substantially uniform distribution of heat to the upper grill rack.

8. The cooker defined in claim 7, in which the apertures of the metal plate are arranged in two rings including a first inner ring of smaller apertures and a second outer ring of larger apertures.

9. The cooker defined in claim 1, in which the stand includes a bottom ring, a middle ring larger than the bottom ring and a top ring larger than the middle ring, and several rods interconnecting said rings, said bottom ring being positioned between the burner and the bowl base, said middle ring being located above the burner, and said outer ring being located above said middle ring.

10. A cooker convertible between operation as a barbecue for grilling food and a stove for heating a cooking utensil, said cooker comprising a bowl having a substantially closed base and an open top, a burner mounted on said base, an open wire stand mounted on said base and extending upward therefrom to a location above said burner for supporting the cooking utensil thereon during use of the cooker as a stove, a grill rack removably mounted in the upper portion of said bowl, above said stand, for supporting food thereon during operation of the cooker as a barbecue, and a metal plate supportable directly on said stand, above said burner but below said grill rack, for distributing heat from said burner to said grill rack during use of the cooker as a barbecue, said stand having an upper portion defining a generally frustoconical supporting area for the cooking utensil, said upper portion of said stand being angled upward and outward at a small acute angle, and said metal plate having an outer annular portion angled upward and outward at a small acute angle approximately equal to the small acute angle of inclination of said upper portion of said stand, such that said metal plate fits on said stand substantially coincidentally with said frustoconical supporting area.

11. The cooker defined in claim 10, in which the stand has a central open portion registered vertically with the burner, the metal plate having a central depression for fitting in said open portion for centering of the metal plate on the stand.

12. The cooker defined in claim 11, in which the stand includes a bottom ring, a middle ring larger than the bottom ring and a top ring larger than the middle ring, and several rods interconnecting said rings, said bottom ring being positioned between the burner and the bowl base, said middle ring being located above the burner, and said outer ring being located above said middle ring.

13. A cooker convertible between operation as a barbecue for grilling food and a stove for heating a cooking utensil, said cooker comprising a bowl having a substantially closed base and an open top, a burner mounted on said base, an open wire stand mounted on said base and extending upward therefrom to a location above said burner for supporting the cooking utensil thereon during use of the cooker as a stove, a grill rack removably mounted in the upper portion of said bowl, above said stand, for supporting food thereon during operation of the cooker as a barbecue, and a metal plate supportable directly on said stand, above said burner but below said grill rack, for distributing heat from said burner to said grill rack during use of the cooker as a barbecue, said stand including a bottom ring, a middle ring larger than the bottom ring and a top ringer larger than the middle ring, and several rods interconnecting said rings, said bottom ring being positioned between said burner and said bowl base, said middle ring being located above said burner, and said outer ring being located above said middle ring.

* * * * *